US011193189B2

(12) United States Patent
Koo et al.

(10) Patent No.: US 11,193,189 B2
(45) Date of Patent: Dec. 7, 2021

(54) ULTRA-HIGH STRENGTH STEEL SHEET HAVING EXCELLENT BENDABILITY AND MANUFACTURING METHOD THEREFOR

(71) Applicant: POSCO, Pohang-si (KR)

(72) Inventors: Min-Seo Koo, Gwangyang-si (KR); Seong-Woo Kim, Gwangyang-si (KR)

(73) Assignee: POSCO, Pohang-si (KR)

( * ) Notice: Subject to any disclaimer, the term of this patent is extended or adjusted under 35 U.S.C. 154(b) by 261 days.

(21) Appl. No.: 16/469,942

(22) PCT Filed: Dec. 7, 2017

(86) PCT No.: PCT/KR2017/014332

§ 371 (c)(1),
(2) Date: Jun. 14, 2019

(87) PCT Pub. No.: WO2018/117501

PCT Pub. Date: Jun. 28, 2018

(65) Prior Publication Data

US 2019/0368015 A1 Dec. 5, 2019

(30) Foreign Application Priority Data

Dec. 19, 2016 (KR) ..... 10-2016-0173552

(51) Int. Cl.
*C22C 38/38* (2006.01)
*C21D 6/00* (2006.01)
(Continued)

(52) U.S. Cl.
CPC ..... *C22C 38/38* (2013.01); *C21D 6/002* (2013.01); *C21D 6/005* (2013.01); *C21D 6/008* (2013.01);
(Continued)

(58) Field of Classification Search
CPC ..... C21D 2211/002; C21D 2211/005; C21D 2211/008; C21D 6/002; C21D 6/005;
(Continued)

(56) References Cited

U.S. PATENT DOCUMENTS

2011/0287280 A1 11/2011 Shiraki et al.
2013/0048151 A1 2/2013 Kawamura et al.
(Continued)

FOREIGN PATENT DOCUMENTS

CN 104109814 10/2014
CN 105829563 8/2016
(Continued)

OTHER PUBLICATIONS

Japanese Office Action—Japanese Application No. 2019-532728 dated Oct. 6, 2020, citing WO 2016/171237, JP 2011-179030, JP 2013-249502, JP 2005-273002, WO 2014/073520, WO 2015/093043, and JP 2015-117403.
(Continued)

*Primary Examiner* — Jenny R Wu
(74) *Attorney, Agent, or Firm* — Cantor Colburn LLP

(57) ABSTRACT

Provided is an ultra-high strength steel sheet used as a material of a vehicle and, more specifically, to an ultra-high strength steel sheet having excellent bendability and a manufacturing method therefor. There is an effect of providing a steel sheet by utilizing a continuous annealing furnace without having water quenching equipment, thereby simultaneously ensuring a tensile strength of 1200 MPa or greater compared with that of conventional super high strength martensite steel and having excellent shape and bending properties.

9 Claims, 1 Drawing Sheet

(51) Int. Cl.

| | |
|---|---|
| ***C21D 8/02*** | (2006.01) |
| ***C21D 9/46*** | (2006.01) |
| ***C21D 9/52*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C23C 2/06*** | (2006.01) |

(52) U.S. Cl.
CPC ..... *C21D 8/0205* (2013.01); *C21D 8/0226* (2013.01); *C21D 8/0236* (2013.01); *C21D 8/0263* (2013.01); *C21D 8/0273* (2013.01); *C21D 9/46* (2013.01); *C21D 9/52* (2013.01); *C22C 38/001* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C23C 2/06* (2013.01); *C21D 2211/002* (2013.01); *C21D 2211/005* (2013.01); *C21D 2211/008* (2013.01)

(58) Field of Classification Search
CPC ..... C21D 6/008; C21D 8/02; C21D 8/0205; C21D 8/0226; C21D 8/0236; C21D 8/0263; C21D 8/0273; C21D 9/46; C21D 9/52; C22C 38/00; C22C 38/001; C22C 38/02; C22C 38/06; C22C 38/22; C22C 38/24; C22C 38/26; C22C 38/28; C22C 38/32; C22C 38/38; C23C 2/02; C23C 2/06; C23C 2/40
See application file for complete search history.

(56) References Cited

U.S. PATENT DOCUMENTS

| | | | | |
|---|---|---|---|---|
| 2015/0275345 | A1 | 10/2015 | Fujita et al. | |
| 2016/0122845 | A1 | 5/2016 | Akiba et al. | |
| 2016/0319385 | A1 | 11/2016 | Hasegawa et al. | |
| 2017/0037488 | A1* | 2/2017 | Hasegawa | C21D 6/008 |
| 2017/0088914 | A1 | 3/2017 | Ikeda et al. | |
| 2018/0105908 | A1 | 4/2018 | Hayashi et al. | |

FOREIGN PATENT DOCUMENTS

| | | |
|---|---|---|
| CN | 106103771 | 11/2016 |
| EP | 2738280 | 6/2014 |
| JP | 05195149 | 8/1993 |
| JP | 10130782 | 5/1998 |
| JP | 2005273002 | 10/2005 |
| JP | 2006083403 | 3/2006 |
| JP | 2010090432 | 4/2010 |
| JP | 2011179030 | 9/2011 |
| JP | 2011246746 | 12/2011 |
| JP | 2013216946 | 10/2013 |
| JP | 2013249502 | 12/2013 |
| JP | 2015117403 | 6/2015 |
| JP | 2015180766 | 10/2015 |
| KR | 20120101596 | 9/2012 |
| KR | 20130106626 | 9/2013 |
| KR | 20130110637 | 10/2013 |
| KR | 20140030970 | 3/2014 |
| KR | 20140031752 | 3/2014 |
| KR | 20140031753 | 3/2014 |
| KR | 20140055463 | 5/2014 |
| KR | 20150001469 | 1/2015 |
| KR | 20150075321 | 7/2015 |
| KR | 20150142791 | 12/2015 |
| KR | 20160013155 | 2/2016 |
| KR | 20160132940 | 11/2016 |
| WO | 2014073520 | 5/2014 |
| WO | 2015093043 | 6/2015 |
| WO | 2016171237 | 10/2016 |

OTHER PUBLICATIONS

Chinese Office Action—Chinese Application No. 201780077610.3 dated Jul. 3, 2020, citing CN 105829563, KR 20130110637, and CN 106103771.

International Search Report—PCT/KR2017/014332 dated Mar. 28, 2018.

European Search Report—European Application No. 17883450.3, dated Aug. 30, 2019, citing EP 3 085 802, JR 2015 180766, KR 2013 0106626, KR 2015 0142791 and EP 2 738 280.

* cited by examiner

ULTRA-HIGH STRENGTH STEEL SHEET HAVING EXCELLENT BENDABILITY AND MANUFACTURING METHOD THEREFOR

TECHNICAL FIELD

The present disclosure relates to an ultra-high strength steel sheet used as a material of a vehicle, and more particularly, to an ultra-high strength steel sheet having excellent bendability and a method of manufacturing the same.

BACKGROUND ART

To reduce a weight of a vehicle steel sheet, a thickness of a steel sheet may need to be reduced, whereas, to secure impact stability, a thickness of a steel sheet may need to be increased, or strength may need to be greatly improved, which may be a contradictory aspect.

To address the issue described above, various steel steels for vehicles such as dual phase steel (DP steel), transformation induced plasticity steel (TRIP steel), complex phase steel (CP steel), and the like, known as AHSS (advanced high strength steel), have been developed.

The strength of such high strength steels may further increase by increasing an amount of carbon or adding alloy components, but in consideration of a practical aspect such as spot weldability, and the like, there may be a limitation in that implementable tensile strength may be on the approximately 1200 MPa level.

Meanwhile, as a steel sheet applicable to a structural member, and the like, to secure impact stability of a vehicle, hot press forming (HPF) steel which may be manufactured by forming at a high temperature and water-cooling, which may secure final strength by rapid cooling through direct contact with a die, has been increasingly used. However, due to excessive facility investment costs and an increase of heat treatment and process costs, the application of the steel may not be easily expanded, which may be a disadvantage.

Accordingly, a roll forming process having high productivity, as compared to the hot press forming, may be used to manufacture a complex shape through multi-stage roll forming, and the method has been increasingly applied with respect to a component forming of an ultra-high strength material having a low elongation rate.

Such steel may be mainly manufactured in a continuous annealing furnace having a water-quenching facility, and a microstructure of steel manufactured therefrom may have a tempered martensite structure formed by tempering martensite. However, during the water-quenching, shape quality may be deteriorated due to a temperature discrepancy between a width direction and a length direction, and when a subsequent roll forming process is applied, the deterioration of workability, a material deviation in each position, and the like, may be caused, which may be a disadvantage.

Thus, research into a measure for substituting for a rapid cooling method through water-cooling has been required.

As an example, reference 1 discloses a cold-rolled steel sheet which may obtain high strength and high ductility at the same time using tempering martensite and which may have an excellent sheet shape after continuous annealing. However, as a content of carbon (C) in an alloy composition is high, 0.2% or higher, there may be a risk of deterioration of weldability, and also a possibility of dents in a furnace caused by the addition of a large amount of Si.

Also, reference 2 discloses martensite steel containing less than 1.5% of Mn in alloy composition to improve bendability, and discloses a method for limiting a gap between inclusions of the steel. In this case, hardenability may be deteriorated due to a low content of alloy elements such that a significantly high cooling speed may be required during cooling, and accordingly, shape quality may be greatly deteriorated.

Reference 3 provides a method of increasing the yield strength of martensite steel. However, the above-described techniques discloses high-alloy-type martensite steel, and the steel may have excellent shape quality as compared to low-alloy-type water-cooled martensite steel, but bending properties, which may be important for improving roll-forming properties and impact properties, may be deteriorated, which may be a disadvantage.

Thus, a measure for manufacturing an ultra-high strength steel sheet having excellent bending properties may be required to improve roll-forming properties and to improve impact properties at the same time.

(Reference 1) Japanese Laid-Open Patent Publication No. 2010-090432

(Reference 2) Japanese Laid-Open Patent Publication No. 2011-246746

(Reference 3) Korean Patent Publication No. 2014-0030970

DISCLOSURE

Technical Problem

An aspect of the present disclosure is to provide an ultra-high strength steel sheet having excellent shape and bending properties such that a weight of a vehicle may be reduced and also impact properties may improve, and a method of manufacturing the same.

Technical Solution

An aspect of the present disclosure provides an ultra-high strength steel sheet having excellent bendability comprising, by wt %, 0.12 to 0.2% of C, 0.5% or less of Si (excluding 0%), 2.5 to 4.0% of Mn, 0.03% or less of P (excluding 0%), 0.015% or less of S (excluding 0%), 0.1% or less of Al (excluding 0%), 1.0% or less of Cr (excluding 0%), 0.01% or less of N (excluding 0%), and a balance of Fe and inevitable impurities, a microstructure of a surface layer region, a portion within 45 μm in a thickness direction from a surface, comprises ferrite of 50 to 70% by area fraction and residual martensite, and a microstructure of a remaining region other than the surface layer region, comprises martensite of 95% or higher and bainite and ferrite of 5% or less by area fraction.

Another aspect of the present disclosure provides a method of manufacturing an ultra-high strength steel sheet having excellent bendability, the method comprising reheating a steel slab satisfying the above-described alloy composition at a temperature range of 1100 to 1300° C.; finish-hot-rolling the reheated steel slab at a temperature range of Ar3 to 1000° C. and manufacturing a hot-rolled steel sheet; coiling the hot-rolled steel sheet at 720° C. or lower; cold-rolling the coiled hot-rolled steel sheet and manufacturing a cold-rolled steel sheet; performing an annealing heat treatment on the cold-rolled steel sheet at a temperature range of Ac3 to 900° C. and at a dew point temperature of −10 to 30° C.; and cooling the cold-rolled steel sheet on which the annealing heat treatment is performed at a cooling rate of 100° C./s or lower, excluding 0° C./s.

Advantageous Effects

According to an aspect of the present disclosure, using a continuous annealing furnace without water-quenching facilities, a steel sheet which may secure tensile strength of 1200 MPa or higher as compared to conventional ultra-high strength martensite steel and may have excellent shape and bending properties at the same time, which may be an effect of the present disclosure.

BEST MODE FOR INVENTION

Figure 1:
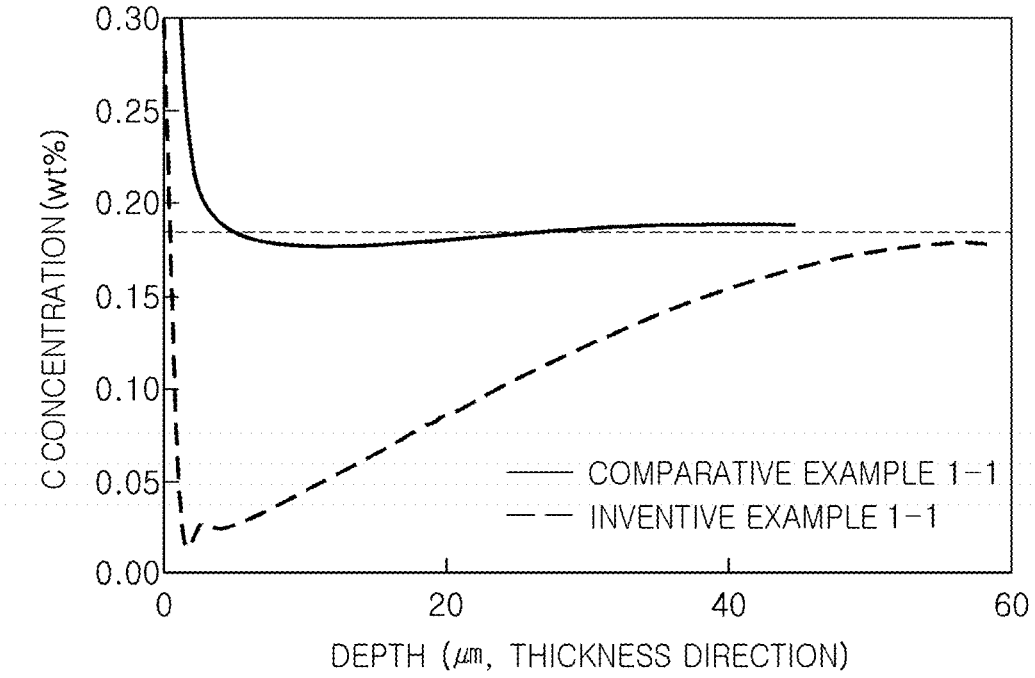
FIG. 1 is graphs of changes in concentration of C of a surface layer region of inventive example 1-1 and comparative example 1-1 to which a continuous annealing heat treatment is performed depending on whether a dew point temperature is controlled according to an example embodiment of the present disclosure.

The inventors have conducted research on a measure for resolving the problem in which, in the case of ultra-high strength martensite steel manufactured using conventional water-quenching, a hot-dip zinc plating process may not be easily performed due to an oxide layer formed on a surface of steel after annealing and cooling, and for having ultra-high strength and securing excellent shape and bending properties at the same time.

As a result, when martensite steel is manufactured using a continuous annealing facility capable of roll-cooling, mist-cooling, gas-cooling, and the like, a facility capable of slow-cooling rather than water-quenching, and by optimizing steel element composition, it has been found that a steel sheet having ultra-high strength and also having excellent shape and bending properties may be manufactured, and the present disclosure has been suggested.

Particularly, in the present disclosure, when manufacturing martensite steel, a surface layer of a steel sheet may be formed as a soft phase by optimizing an annealing heat treatment condition, thereby greatly improving bending properties, which may be a technical feature of the present disclosure.

Hereinafter, the present disclosure will be described in detail.

An ultra-high strength steel sheet having excellent bendability, an aspect of the present disclosure, may include, by wt %, 0.12 to 0.2% of C, 0.5% or less of Si (excluding 0%), 2.5 to 4.0% of Mn, 0.03% or less of P (excluding 0%), 0.015% or less of S (excluding 0%), 0.1% or less of Al (excluding 0%), 1.0% or less of Cr (excluding 0%), 0.01% or less of N (excluding 0%) preferably.

In the description below, the reason why an alloy element composition of the ultra-high strength steel sheet provided in the present disclosure is limited as above will be described in detail. A content of each element may be represented by wt % unless otherwise indicated.

C: 0.12 to 0.2%

Carbon (C) is an essential element for securing strength of steel. Particularly, to secure ultra-high strength, it may be preferable to add 0.12% or higher of C. However, when a content of C exceeds 0.2%, there may be the problem of deterioration of weldability, and thus, it may be preferable to limit an upper limit content of C to 0.2%.

Thus, in the present disclosure, it may be preferable to control a content of C to be 0.12 to 0.2%. A more preferable content of C may be 0.13 to 0.18%.

Si: 0.5% or less (excluding 0%)

Silicon (Si) is a ferrite stabilization element. Si may have a disadvantage in that Si may weaken strength of steel by facilitating the formation of ferrite during cooling (in this case, the cooling is slow-cooling) after annealing in a continuous annealing furnace in which a slow-cooling section is present. Also, when a large amount of Mn is added to prevent phase transformation as in the present disclosure, there may be a risk of a dent defect caused by surface concentration and oxidation by Si during annealing. Thus, it may be preferable to limit a content of Si to 0.5% or less.

Thus, in the present disclosure, it may be preferable to control a content of Si to be 0.5% or less, and in consideration of an inevitably added level during a manufacturing process, 0% may be excluded.

Mn: 2.5 to 4.0%

Manganese (Mn) is an element which may prevent the formation of ferrite and may easily cause the formation of austenite. When a content of Mn is lower than 2.5%, there may be a problem in which the formation of ferrite may easily be caused during slow-cooling. When a content of Mn exceeds 4.0%, there may be problems in which a band may be formed by segregation, and the excessive content of Mn may become a cause of increasing raw material costs of alloy iron due to excessive addition of alloy during a converter operation.

Thus, in the present disclosure, it may be preferable to limit a content of Mn to 2.5 to 4.0%. A more preferable content of Mn may be 2.8% or higher, and an even more preferable content of Mn may be 3.0% or higher.

P: 0.03% or less (excluding 0%)

Phosphorous (P) is an impurity element in steel. When a content of P exceeds 0.03%, weldability may degrade, a possibility of brittleness of steel may increase, and a possibility of a dent defect may also increase. Thus, it may be preferable to limit an upper limit content to 0.03%. However, in consideration of an inevitably added level during a manufacturing process of steel, 0% may be excluded.

S: 0.015% or less (excluding 0%)

Sulfur (S) is an impurity element in steel similarly to P, and is known as an element which may deteriorate ductility and weldability of steel. When a content of S exceeds 0.015%, a possibility of deterioration of ductility and weldability of steel may increase. Thus, it may be preferable to limit an upper limit content of S to 0.015%. However, in consideration of an inevitably added level during a manufacturing process of steel, 0% may be excluded.

Al: 0.1% or less (excluding 0%)

Aluminum (Al) is an element which may expand a ferrite region. When a continuous annealing process including slow-cooling is used as in the present disclosure, Al may facilitate the formation of ferrite, which may be a disadvantage of Al. Also, Al may deteriorate high temperature hot-rolling properties by forming AlN, and thus, it may be preferable to limit an upper limit content of Al to 0.1%. However, in consideration of an inevitably added level during a manufacturing process of steel, 0% may be excluded.

Cr: 1.0% or less (excluding 0%)

Chromium (Cr) is an element which may easily secure a low temperature transformation structure by preventing ferrite transformation. Thus, Cr may have an advantageous effect of preventing the formation of ferrite during cooling. However, when a content of Cr exceeds 1.0%, there may be the problem in which raw material costs of alloy iron may increase due to excessive addition of alloy.

Thus, it may be preferable to limit an upper limit content of Cr to 1.0%, and 0% may be excluded. More preferably, it may be advantageous to include 0.1 to 1.0% of Cr.

N: 0.01% or less (excluding 0%)

When a content of Nexceeds 0.01%, a risk of cracks during continuous casting may greatly increase by the formation of AlN, and thus, it may be preferable to limit an upper limit content of N to 0.01%. However, in consideration of an inevitably added level during a manufacturing process of steel, 0% may be excluded.

The steel sheet of the present disclosure may further include the element as below in addition to the above-described elements to further improve properties of steel.

B: 0.005% or less (excluding 0%)

Boron (B) is an element which may have an effect of preventing the formation of ferrite. In the present disclosure, B may be useful to prevent the formation of ferrite during cooling after annealing. However, when a content of B exceeds 0.005%, there may be the problem in which the formation of ferrite may rather be facilitated by precipitation of $Fe_{23}(C, B)_6$.

Thus, in the present disclosure, it may be preferable to control a content of B to be 0.005% or less, and 0% may be excluded.

Mo: 0.1% or less (excluding 0%)

Molybdenum (Mo) is an element which may have an effect of preventing the formation of ferrite by increasing hardenability of steel. In the present disclosure, Mo may be useful to prevent the formation of ferrite during cooling after annealing. However, when a content of Mo exceeds 0.1%, there may be the problem in which raw material costs of alloy iron may increase due to excessive addition of alloy.

Thus, in the present discourse, it may be preferable to control a content of Mo to be 0.1% or less, and 0% may be excluded.

Ti: 0.1% or less (excluding 0%)

Titanium (Ti) is a nitride formation element. Ti may perform scavenging by precipitating N in steel to TiN such that the precipitation of AlN may be prevented, and Ti may thus have an effect of decreasing a risk of cracks during continuous casting. It may have preferable to add 48/14*[N (weight %)] or higher of Ti by chemical equivalent. However, when a content of Ti exceeds 0.1%, there may be the problem of degradation of strength of steel by carbide precipitation in addition to removal of solute N, and the content may thus not be preferable.

Thus, when Ti is added, it may be preferable to control an upper limit content of Ti to be 0.1%, and 0% may be excluded.

Nb: 0.1% or less (excluding 0%)

Niobium (Nb) is an element which may be segregated to an austenite grain boundary and may prevent an austenite grain from being coarse during an annealing heat treatment. When a content of Nb exceeds 0.1%, there may be the problem in which raw material costs of alloy iron may increase due to excessive addition of alloy.

Thus, when Nb is added, it may be preferable to control an upper limit content of Nb to be 0.1%, and 0% may be excluded.

Zr: 0.1% or less (excluding 0%)

Zirconium (Zr) is a nitride formation element, and Zr may perform scavenging by precipitating N in steel to ZrN such that the precipitation of AlN may be prevented, and Zr may thus have an effect of decreasing a risk of cracks during continuous casting. It may be preferable to add 91/14*[N (weight %)] or higher of Zr by chemical equivalent. However, when a content of Zr exceeds 0.1%, there may be the problem of degradation of strength of steel by carbide precipitation in addition to removal of solute N, and the content may thus not be preferable.

Thus, when Zr is added, it may be preferable to control an upper limit content of Zr to be 0.1%, and 0% may be excluded.

V: 0.1% or less (excluding 0%)

Vanadium (V) is a nitride formation element, and V may perform scavenging by precipitating N in steel to VN such that the precipitation of AlN may be prevented, and V may thus have an effect of decreasing a risk of cracks during continuous casting. It may have preferable to add 51/14*[N (weight %)] or higher of V by chemical equivalent. However, when a content of V exceeds 0.1%, there may be the problem of degradation of strength of steel by carbide precipitation in addition to removal of solute N, and the content may thus not be preferable.

Thus, when V is added, it may be preferable to control an upper limit content of V to be 0.1%, and 0% may be excluded.

A remainder other than the above-described composition is Fe. However, in a general manufacturing process, inevitable impurities may be inevitably added from raw materials or a surrounding environment, and thus, impurities may not be excluded. A person skilled in the art may be aware of the impurities, and thus, the descriptions of the impurities may not be provided in the present disclosure.

The ultra-high strength steel sheet satisfying the above-described alloy composition may include a microstructure configured as below preferably.

Specifically, a microstructure of a surface layer region (a portion within 45 μm in a thickness direction from a surface) of the ultra-high strength steel sheet of the present disclosure may include ferrite of 50 to 70% by area fraction and residual martensite, and a microstructure of a remaining region (may be referred to as a center region) other than the surface layer region may include martensite of 95% or higher and bainite and ferrite of 5% or lower by area fraction preferably.

Although described in the description below later, in the present disclosure, during annealing in a continuous annealing facility including a facility capable of slow-cooling, by optimizing conditions thereof and by decarburization of a surface of the steel sheet, a soft phase may be formed on the surface layer region of the steel sheet.

When a fraction of a ferrite phase on the surface layer region is lower than 50%, bendability may be deteriorated such that cracks may be created during a bending process. When a fraction of the ferrite phase exceeds 70%, a fraction of a martensite phase may be relatively low, such that strength may excessively decrease, which may be a problem.

As described above, it may be preferable to form 0.12% or lower (excluding 0%) of carbon (C) in the surface layer region by decarburization of a surface of the steel sheet. When a content of C in the surface layer region exceeds 0.12%, it may be impossible to secure a sufficient fraction of a soft phase in the surface layer region, and the content may thus not be preferable.

A remaining region other than the surface layer region, may include a martensite phase, a hard phase, as a main phase preferably. When a fraction of a martensite phase is lower than 95%, there may be the problem in which it may be difficult to secure ultra-high strength, tensile strength of 1200 MPa or higher, which is target strength of the present disclosure.

When the surface layer region and the remaining region other than the surface layer region include a martensite phase in the present disclosure, a martensite phase may further include a tempered martensite phase. In this case, it may be preferable to control a sum of a martensite phase and a tempered martensite phase to satisfy a target area fraction.

The steel sheet of the present disclosure satisfying both of the alloy composition and the microstructure as described above may have tensile strength of 1200 MPa or higher and a bendability index (R/t) of 4 or lower, and may thus secure ultra-high strength and excellent bendability at the same time. The steel sheet of the present disclosure may be a cold-rolled steel sheet or a hot-dip galvanized steel sheet.

R in the bendability index may be R of a punch during 90 degrees bending, and t may indicate a thickness (mm) of a material.

In the description below, a method of manufacturing an ultra-high strength steel sheet having excellent bendability, another aspect of the present disclosure, will be described in detail.

The ultra-high strength steel sheet according to the present disclosure may be manufactured through processes of reheating, hot-rolling, coiling, cold-rolling, annealing, and cooling a steel slab satisfying the alloy composition suggested in the present disclosure. In the description below, conditions of each process will be described in detail.

[Reheating Steel Slab]

In the present disclosure, a steel slab may be homogenized by reheating the steel slab before performing a hot-rolling process, and it may be preferable to perform the reheating process at 1100 to 1300° C.

When the reheating temperature is lower than 1100° C., there may be the problem of an excessive increase of a weight during a subsequent hot-rolling process. When the temperature exceeds 1300° C., the amount of surface scale may increase, which may lead to loss of a material, and may thus not be preferable.

[Hot-Rolling]

The reheated steel slab may be hot-rolled and manufactured as a hot-rolled steel sheet preferably. It may be preferable to perform a finish-hot-rolling at a temperature of Ar3 or higher and 1000° C. or lower.

When a temperature during the finish-hot-rolling is lower than Ar3 (a temperature at which austenite is transformed to ferrite during cooling), a ferrite+austenite two-phase region or a ferrite region rolling may be performed such that a duplex grain structure may be formed, and a miss-operation may occur due to change in hot-rolling weight, which may not be preferable. When the finish-hot-rolling temperature exceeds 1000° C., a possibility of a surface defect caused by scale may increase, which may not be preferable.

[Coiling]

It may be preferable to coil the hot-rolled steel sheet manufactured as above at 720° C. or lower.

When a temperature during the coiling exceeds 720° C., an oxide film may be excessively formed on a surface of the steel sheet and may cause a defect. Thus, it may be preferable to limit an upper limit thereof to 720° C. The lower the coiling temperature, the higher the strength of the hot-rolled steel sheet may be such that a rolling weight of a subsequent cold-rolling process may increase, which may be a disadvantage, but it may not be a cause for failing an actual production. Thus, a lower limit thereof will not be particularly limited. However, to easily perform a subsequent cold-rolling process, it may be preferable to perform the coiling at Ms (a martensite transformation initiating temperature) or higher.

[Cold-Rolling and Annealing Heat Treatment]

The coiled hot-rolled steel sheet may be pickled and cold-rolled, and an annealing heat treatment may be performed in a continuous annealing furnace without a water quenching device, that is, in a continuous annealing furnace including a slow-cooling section, preferably.

The cold-rolling is a process for securing a thickness required by a customer, and a reduction ratio in the cold-rolling may not be particularly limited. Generally, a lower limit of a cold press reduction ratio may be determined in consideration of recrystallization during a subsequent annealing process, but in the present disclosure, as an austenite single phase annealing may be performed at Ac3 or higher during the annealing, the lower limit may not be particularly limited.

The annealing heat treatment may be performed at a temperature of Ac3 (a temperature in which ferrite is transformed to an austenite single phase when a temperature increases) or higher preferably, which may be to secure 100% of an austenite fraction during the annealing. Meanwhile, it may be metallurgically preferable to limit an upper limit of the temperature during the annealing heat treatment up to a temperature before liquid appears. However, to prevent the deterioration of durability of the continuous annealing furnace, substantially, it may be preferable to limit an upper limit of the annealing heat treatment to 900° C.

When the annealing heat treatment is performed at the above-mentioned temperature range, it may be preferable to control a dew point temperature in the continuous annealing furnace to be −10 to 30° C. The process may be to form a soft structure, preferably a 50 to 70% of ferrite phase by area fraction, on a surface layer region of the ultra-high strength steel sheet by decarburization of the surface layer region, the ultra-high strength steel sheet manufactured by a series of processes of the present disclosure. When the dew point temperature exceeds 30° C., the formation of a decarburized layer may become excessive on a surface layer such that there may be a risk of degradation of strength. When the dew point temperature is lower than −10° C., the formation of a decarburized layer may rather be prevented on a surface layer such that it may be difficult to form a sufficient area fraction of a soft phase, and consequently, there may be the problem of difficulty in improving bendability.

By performing the annealing heat treatment under the condition in which the heat treatment temperature and the dew point temperature are controlled, a content of carbon (C) in the surface layer region after the annealing heat treatment may decrease to 0.12% or lower.

Also, in the present disclosure, by controlling a dew point temperature of an atmospheric gas during the annealing heat treatment and by forming a soft structure through decarburization of the surface layer region (a portion within 40 μm in a thickness direction from a surface) of the steel sheet, bending properties which may be deteriorated by adding a large amount of alloy elements such as Mn, and the like, may be improved, and thus, bending properties of the manufactured ultra-high strength steel sheet may further be improved.

In other words, when the concentration of C in the surface layer region of the steel sheet is the same or exceeds the concentration of added C, a bendability index (R/t), an index which may examine bending properties, may exceeds 4 and bending properties may be deteriorated. However, in the present disclosure, by decreasing the concentration of C of the surface layer region to 0.12% or less, it may be possible to secure the bendability index (R/t) of 4 or lower. This is because cracks may be prevented during a bending process as a soft structure is formed by decarburization of the surface layer region of the steel sheet.

Meanwhile, the lower the bendability index (R/t), the more excellent the bending formability may be.

[Cooling]

A slow-cooling may be performed to room temperature at a cooling rate of 100° C./s or lower after the annealing heat treatment preferably.

When a conventional water-quenching is performed, a cooling rate may exceeds 100° C./s such that a temperature discrepancy between a width direction and a length direction may increase, and sheet shape quality may be greatly deteriorated. Accordingly, there may be the problem in which a wave height (a difference in height of a steel sheet in every 1000 mm) may become 10 mm or greater. Also, it has been known that, even when a cooling rate is secured to a 200° C./s level by strongly applying mist-cooling, a wave height may become a several mm level due to a temperature discrepancy between a width direction and a length direction.

Accordingly, in the present disclosure, the cooling speed may be limited to 100° C./s or lower (excluding 0° C./s) to secure shape quality of the steel.

As an example, in the cooling, the steel sheet may be slow-cooled to a temperature range of 600 to 700° C. at a cooling rate of 10° C./s or lower and may be cooled to an overaging heat treatment temperature (a general condition) at a cooling rate of 30° C./s or lower. Thereafter, an overaging heat treatment may be performed, and a final cooling may be performed to 150° C. or lower.

As described above, to secure strength at a slow cooling rate as compared to a conventional cooling, hardenability of steel may be secured by adding a large amount of Mn, and by additionally adding alloy elements such as B, Mo, Cr, and the like, higher hardenability may be secured.

In the present disclosure, the cold-rolled steel sheet manufactured through the processes above may be heated to 450° C. or higher and may be submerged in a zinc plating bath, or may be submerged in a zinc plating bath at a temperature of the steel sheet of 450° C. or higher during cooling after annealing, thereby manufacturing a hot-dip galvanized steel sheet having a hot-dip galvanized layer.

Meanwhile, to include a tempered martensite phase in the surface layer region and a remaining region other than the surface layer region of the cold-rolled steel sheet or the hot-dip galvanized steel sheet manufactured as above, a BAF process (bath annealing furnace process) may further be performed on a material which has been passed through an annealing process and/or a hot-dip zinc plating line in a continuous annealing line. In the BAF process, a heat treatment may be performed at a temperature range of 150 to 250° C. for 17 to 24 hours preferably, thereby further improving yield strength.

In the description below, an example embodiment of the present disclosure will be described in greater detail. It should be noted that the exemplary embodiments are provided to describe the present disclosure in greater detail, and to not limit the present disclosure. The scope of right of the present disclosure may be determined based on the matters recited in the claims and the matters rationally inferred therefrom.

MODE FOR INVENTION

Embodiment

Steel having an element composition as in Table 1 was vacuum-dissolved to be an ingot of a weight of 34 kg, was maintained at 1200° C. for 1 hour, was finish-rolled at 900° C., was charged to a furnace heated in advance to 680° C. and maintained for 1 hour, and was furnace-cooled, thereby simulating a hot-rolling coiling process. The steel was pickled and 50%-cold-rolled and manufactured as a cold-rolled steel sheet. Thereafter, an annealing heat treatment was performed on the cold-rolled steel sheet at 820° C. for simulating a continuous annealing process, and the cold-rolled steel sheet was slow-cooled to 650° C. at a cooling rate of 3° C./s, and was cooled to 440° C. at a general cooling rate of 20° C./s. Then, an overaging heat treatment was performed on the cold-rolled steel sheet for 360 seconds, and the cold-rolled steel sheet was cooled to room temperature at a cooling rate of 3° C./s, thereby simulating a continuous annealing process.

When simulating a continuous annealing hot-dip plating process, an annealing heat treatment was performed on a cold-rolled steel sheet manufactured by pickling and cold-rolling at 820° C., the cold-rolled steel sheet was slow-cooled to 650° C. at a cooling rate of 3° C./s and was cooled to 560° C. at a cooling rate of 6° C./s, and an overaging heat treatment was performed. Thereafter, a hot-dip zinc plating process was performed by submerging the cold-rolled steel sheet in a hot-dip plating port of 460° C., and a cooling process was performed to room temperature at a cooling rate of 3° C./s.

A dew point temperature condition during the annealing heat treatment was controlled as in Table 2 below.

Mechanical properties of the samples to which the above-described heat treatment was performed were measured, and the results were listed in Table 2.

TABLE 2

| Steel | Alloy Composition (Weight %) | | | | | | | | | | | |
|---|---|---|---|---|---|---|---|---|---|---|---|---|
| Type | C | Si | Mn | P | S | Al | Cr | Ti | Nb | B | N | Mo |
| Inventive Steel 1 | 0.176 | 0.12 | 3.6 | 0.0083 | 0.005 | 0.023 | 0.12 | 0.12 | 0.042 | 0.0021 | 0.004 | 0 |
| Inventive Steel 2 | 0.15 | 0.11 | 3.0 | 0.0079 | 0.006 | 0.025 | 0.8 | 0.02 | 0.041 | 0.0019 | 0.0038 | 0 |
| Inventive Steel 3 | 0.173 | 0.11 | 3.59 | 0.0081 | 0.0058 | 0.026 | 0.11 | 0 | 0.041 | 0 | 0.0038 | 0 |
| Inventive Steel 4 | 0.131 | 0.1 | 3.45 | 0.0086 | 0.0062 | 0.025 | 0.71 | 0.05 | 0.04 | 0.002 | 0.0043 | 0 |
| Inventive Steel 5 | 0.135 | 0.12 | 3.21 | 0.0091 | 0.0049 | 0.026 | 0.68 | 0 | 0.04 | 0 | 0.0039 | 0.05 |
| Comparative Example 1 | 0.18 | 0.11 | 3.61 | 0.009 | 0.0056 | 0.025 | 0.11 | 0.021 | 0.041 | 0.002 | 0.0055 | 0 |

TABLE 2-continued

| Steel | Alloy Composition (Weight %) | | | | | | | | | | | |
|---|---|---|---|---|---|---|---|---|---|---|---|---|
| Type | C | Si | Mn | P | S | Al | Cr | Ti | Nb | B | N | Mo |
| Comparative Example 2 | 0.15 | 0.1 | 2.9 | 0.010 | 0.006 | 0.02 | 0.71 | 0.019 | 0.039 | 0.0018 | 0.0057 | 0 |
| Comparative Example 3 | 0.13 | 0.09 | 2.1 | 0.012 | 0.0056 | 0.024 | 0.72 | 0.056 | 0.041 | 0.0018 | 0.0054 | 0 |
| Comparative Example 4 | 0.1 | 0.1 | 3.53 | 0.011 | 0.0048 | 0.026 | 0.11 | 0.021 | 0.038 | 0.0016 | 0.0037 | 0 |
| Comparative Example 5 | 0.2 | 0.20 | 1.1 | 0.010 | 0.0054 | 0.031 | 0.1 | 0 | 0.01 | 0 | 0.004 | 0 |

(In Table 1, in comparative steels 1 and 2, the alloy compositions satisfied the ranges suggested in the present disclosure, but the manufacturing conditions did not satisfy the present disclosure, and thus, the steels were indicated as comparative steels.)

TABLE 2

| | Manufacturing Conditions | | Surface Layer Region | | | | Remaining Region | | | Mechanical Properties | | | | |
|---|---|---|---|---|---|---|---|---|---|---|---|---|---|---|
| Steel Type | Annealing Process | Dew Point Temperature (° C.) | Decarburized Layer Depth (μm) | Content of C of Decarburized Layer (wt %) | F (%) | M (%) | B + F (%) | M + TM (%) | P (%) | YS (MPa) | TS (MPa) | El (%) | R/t | Classification |
| Inventive Steel 1 | CAL | −48 | 0 | 0.185 | — | — | 1 | 99 | 0 | 1040 | 1559 | 7.6 | 4.5 | Comparative Example 1-1 |
| | CAL | 10 | 35 | 0.110 | 62 | 38 | 1 | 99 | 0 | 1003 | 1502 | 6.5 | 3.3 | Inventive Example 1-1 |
| | CGL | −42 | 0 | 0.192 | — | — | 1 | 99 | 0 | 1072 | 1588 | 7.6 | 5.5 | Comparative Exam 1-2 |
| | CGL | 15 | 39 | 0.105 | 65 | 35 | 1 | 99 | 0 | 1023 | 1528 | 6.7 | 3.9 | Inventive Example 1-2 |
| Inventive Steel 2 | CAL | −39 | 0 | 0.160 | — | — | 3 | 97 | 0 | 1031 | 1399 | 7.1 | 4.2 | Comparative Exam 2-1 |
| | CAL | 8 | 33 | 0.120 | 59 | 41 | 3 | 97 | 0 | 998 | 1347 | 6.2 | 3.0 | Inventive Example 2-1 |
| | CGL | −50 | 0 | 0.153 | — | — | 3 | 97 | 0 | 1052 | 1412 | 7.6 | 4.8 | Comparative Exam 2-2 |
| | CGL | 17 | 40 | 0.108 | 65 | 35 | 3 | 97 | 0 | 1008 | 1381 | 6.4 | 3.8 | Inventive Example 2-2 |
| Inventive Steel 3 | CGL | −44 | 0 | 0.191 | — | — | 1 | 99 | 0 | 936 | 1553 | 8.3 | 4.5 | Comparative Exam 3-1 |
| | CGL | 14 | 36 | 0.115 | 66 | 34 | 1 | 99 | 0 | 892 | 1510 | 7.4 | 3.3 | Inventive Example 3-1 |
| Inventive Steel 4 | CGL | −46 | 0 | 0.145 | — | — | 2 | 98 | 0 | 866 | 1452 | 7.2 | 4.4 | Comparative Exam 4-1 |
| | CGL | 0 | 28 | 0.120 | 51 | 49 | 2 | 98 | 0 | 823 | 1411 | 6.4 | 3.6 | Inventive Example 4-1 |
| Inventive Steel 5 | CGL | −49 | 0 | 0.146 | — | — | 2 | 98 | 0 | 871 | 1445 | 7.1 | 4.4 | Comparative Exam 5-1 |
| | CGL | 20 | 42 | 0.112 | 70 | 30 | 2 | 98 | 0 | 834 | 1403 | 6.2 | 3.5 | Inventive Example 5-1 |
| Comparative Example 1 | CAL | −45 | 0 | 0.194 | — | — | 1 | 99 | 0 | 1117 | 1532 | 7.4 | 4.6 | Comparative Exam 6-1 |
| | CGL | −43 | 0 | 0.192 | — | — | 1 | 99 | 0 | 1144 | 1525 | 7.2 | 5.0 | Comparative Exam 6-2 |
| Comparative Example 2 | CAL | −50 | 0 | 0.164 | — | — | 1 | 99 | 0 | 1045 | 1398 | 7.2 | 4.2 | Comparative Exam 7-1 |
| | CGL | −48 | 0 | 0.158 | — | — | 1 | 99 | 0 | 1078 | 1418 | 6.0 | 4.5 | Comparative Exam 7-2 |
| Comparative Example 3 | CGL | −43 | 0 | 0.142 | — | — | 72 | 20 | 8 | 690 | 985 | 20.4 | 1.0 | Comparative Exam 8 |
| Comparative Example 4 | CGL | −40 | 0 | 0.115 | — | — | 1 | 99 | 0 | 1020 | 1375 | 6.2 | 5.0 | Comparative Exam 9 |
| Comparative Example 5 | CAL | −49 | 0 | 0.220 | — | — | 73 | 0 | 27 | 410 | 540 | 26.5 | 0 | Comparative Exam 10-1 |
| | CGL | −39 | 0 | 0.240 | — | — | 82 | 0 | 18 | 408 | 533 | 27.5 | 0 | Comparative Exam 10-2 |

(In Table 2, CAL indicates a continuous annealing line, and CGL indicates continuous galvanizing line.

Also, F is ferrite, B is bainite, M is martensite, TM is tempered martensite, and P is pearlite.

Also, YS is yield strength, TS is tensile strength, an El is an elongation rate.)

As indicated in Tables 1 and 2, as for inventive example 1-1 to inventive example 5-1 satisfying both of the alloy composition and the manufacturing conditions of the present disclosure, as a decarburized layer was formed on a surface layer region (up to a maximum of 42 μm in a thickness direction from a surface), bendability index (R/t) were 4 or lower, and bending properties were thus excellent. Also, a matrix structure of the steel sheet was mainly formed as a martensite phase, and ultra-high strength, tensile strength of 1200 MPa or higher, was secured.

As for comparative example 1-1 to comparative example 7-2 of which the alloy compositions satisfied the present discourse but the dew point temperatures during annealing did not satisfy the conditions of the present discourse, a decarburized layer was not formed at all, and accordingly, bending properties were deteriorated.

As for comparative example 8, comparative example 10-1, and comparative example 10-2 of which the alloy compositions and the manufacturing conditions did not satisfy the present disclosure, a matrix structure was not formed as martensite+tempered martensite such that it was not possible to secure ultra-high strength. This is because a matrix structure of the steel sheet was formed as a complex structure, not a hard structure.

As for comparative example 9, as a decarburized layer was not formed, bending properties were deteriorated.

FIG. 1 is graphs of changes in concentration of C of a surface layer region depending on whether a dew point is controlled. As indicated in FIG. 1, the concentration of C of the surface layer region of inventive example 1-1 was lower than that of comparative example 1-1.

Figure 2:
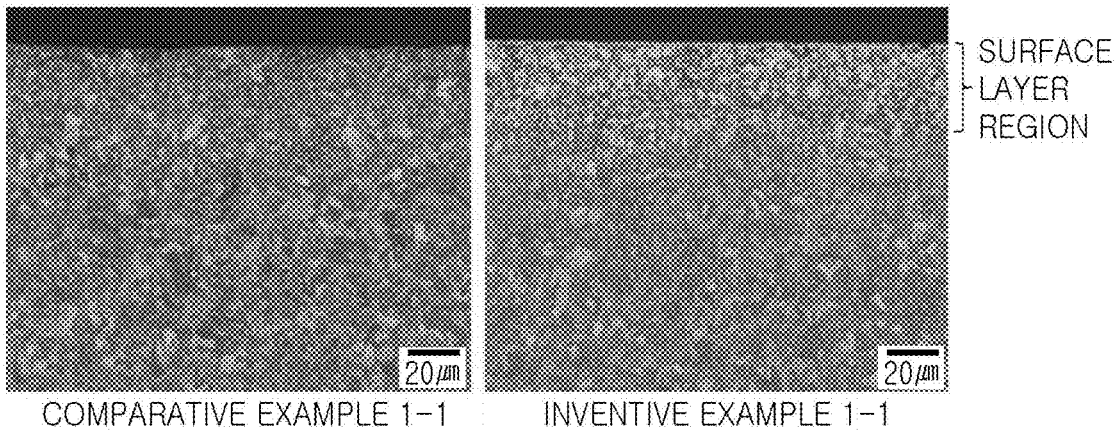
FIG. 2 is images of a cross-sectional structure of a surface layer region of inventive example 1-1 and of comparative example 1-1 to which a continuous annealing heat treatment is performed according to an example embodiment of the present disclosure.

FIG. 2 is images of a cross-sectional structure of a surface layer region of inventive example 1-1 and of comparative example 1-1. As indicated in FIG. 2, a soft structure (white region) was formed on the surface layer region of inventive example 1-1 as compared to comparative example 1-1.

The invention claimed is:

1. An ultra-high strength steel sheet having bendability, the steel sheet comprising:

by wt%, 0.12 to 0.2% of C, 0.5% or less of Si excluding 0%, 2.5 to 4.0% of Mn, 0.03% or less of P excluding 0%, 0.015% or less of S excluding 0%, 0.1% or less of Al excluding 0%, 1.0% or less of Cr excluding 0%, 0.01% or less of N excluding 0%, and a balance of Fe and inevitable impurities, wherein a microstructure of a surface layer region, the surface layer region being defined by a portion within 45 μm in a thickness direction from a surface, comprises ferrite of 50 to 70% by area fraction and residual martensite, and a content of carbon in the surface layer region is 0.12 wt % or less excluding 0 wt %, and wherein a microstructure of a remaining region other than the surface layer region comprises martensite of 95% or higher and bainite and ferrite of 5% or less by area fraction, and wherein the steel sheet has tensile strength of 1200 MPa or higher, and a bendability index, R/t, of 4 or lower.

2. The ultra-high strength steel sheet of claim 1, wherein the steel sheet further comprises, by wt%, one or more of 0.005% or less of B excluding 0%, 0.1% or less of Mo excluding 0%, 0.1% or less of Ti excluding 0%, 0.1% or less of Nb excluding 0%, 0.1% or less of Zr excluding 0%, and 0.1% or less of V excluding 0%.

3. The ultra-high strength steel sheet of claim 1, wherein the steel sheet has tensile strength of 1200 MPa or higher, and a bendability index, R/t, of 4 or lower.

4. The ultra-high strength steel sheet of claim 1, wherein the steel sheet is a cold-rolled steel sheet or a galvanized steel sheet.

5. A method of manufacturing an ultra-high strength steel sheet having excellent bendability, the method comprising:

reheating a steel slab at a temperature range of 1100 to 1300° C., the steel slab comprising, by wt%, 0.12 to 0.2% of C, 0.5% or less of Si excluding 0%, 2.5 to 4.0% of Mn, 0.03% or less of P excluding 0%, 0.015% or less of S excluding 0%, 0.1% or less of Al excluding 0%, 1.0% or less of Cr excluding 0%, 0.01% or less of N excluding 0%, and a balance of Fe and inevitable impurities;

finish-hot-rolling the reheated steel slab at a temperature range of Ar3 to 1000° C. to form a hot-rolled steel sheet;

coiling the hot-rolled steel sheet at 720° C. or lower;

cold-rolling the coiled hot-rolled steel sheet to form a cold-rolled steel sheet;

performing an annealing heat treatment on the cold-rolled steel sheet at a temperature range of Ac3 to 900° C. and at a dew point temperature of −10 to 30° C. to form an annealing heated cold-rolled steel sheet; and cooling the annealing heated cold-rolled steel sheet at a cooling rate of 100° C./s or lower excluding 0° C./s to a temperature of 150° C. or less to form an annealed cold-rolled steel sheet.

6. The method of claim 5, wherein the steel slab further comprises, by wt%, one or more of 0.005% or less of B excluding 0%, 0.1% or less of Mo excluding 0%, 0.1% or less of Ti excluding 0%, 0.1% or less of Nb excluding 0%, 0.1% or less of Zr excluding 0%, and 0.1% or less of V excluding 0%.

7. The method of claim 5, wherein the coiling is performed at Ms or higher.

8. The method of claim 5, wherein, during the annealing heat treatment, decarburization occurs in a surface layer region, the surface layer region being defined by a portion within 45 μm in a thickness direction from a surface of the cold-rolled steel sheet, and after the annealing heat treatment, a content of carbon in the surface layer region is 0.12 wt % or less.

9. The method of claim 5, further comprising: forming a hot-dip galvanized layer by submersing the annealed cold-rolled steel sheet in a zinc plating bath after the cooling.

* * * * *